US006188942B1

(12) United States Patent
Corcoran et al.

(10) Patent No.: US 6,188,942 B1
(45) Date of Patent: Feb. 13, 2001

(54) METHOD AND APPARATUS FOR DETERMINING THE PERFORMANCE OF A COMPACTION MACHINE BASED ON ENERGY TRANSFER

(75) Inventors: Paul T. Corcoran; Federico Fernandez, both of Washington, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/326,439

(22) Filed: Jun. 4, 1999

(51) Int. Cl.[7] ..... G01L 5/00; E01C 19/26; E02D 1/00

(52) U.S. Cl. ..... 701/50; 701/207

(58) Field of Search ..... 701/50, 207; 340/995; 342/357.17

(56) References Cited

U.S. PATENT DOCUMENTS

| | | | | |
|---|---|---|---|---|
| 4,149,253 | * | 4/1979 | Paar et al. | 701/50 |
| 4,467,652 | | 8/1984 | Thurner AB et al. | 73/573 |
| 4,870,601 | | 9/1989 | Sandstrom | 364/550 |
| 5,426,972 | | 6/1995 | Heirtzler et al. | 73/84 |
| 5,471,391 | | 11/1995 | Gudat et al. | 364/424.07 |
| 5,493,494 | * | 2/1996 | Henderson | 701/50 |
| 5,695,298 | | 12/1997 | Sandstrom | 404/72 |
| 5,719,338 | | 2/1998 | Magalski et al. | 73/66 |
| 5,787,378 | * | 7/1998 | Schricker | 701/50 |

FOREIGN PATENT DOCUMENTS

| | | | |
|---|---|---|---|
| 9-79924 | * | 3/1997 | (JP) . |
| WO8201905 | | 6/1982 | (WO) . |
| WO8603237 | | 6/1986 | (WO) . |
| WO9420684 | | 9/1994 | (WO) . |
| WO9725680 | | 11/1994 | (WO) . |

* cited by examiner

*Primary Examiner*—Michael J. Zanelli
(74) *Attorney, Agent, or Firm*—Steve D. Lundquist

(57) ABSTRACT

In a first embodiment, a method and apparatus for determining compaction performance of a material by a compactor having a known compaction width. The method and apparatus includes determining a lift thickness of the material, determining a rolling resistance of the compactor, determining a level of compactive energy delivered to the material as a function of the compaction width, the lift thickness and the rolling resistance, and determining the compaction performance of the material as a function of the compactive energy. In a second embodiment, a method and apparatus for determining compaction performance of a material by a compactor. The method and apparatus includes determining a ground speed of the compactor, determining a rolling resistance of the compactor, determining a propelling power of the compactor as a function of the ground speed and the rolling resistance, and determining the compaction performance of the material as a function of the propelling power of the compactor.

42 Claims, 4 Drawing Sheets

METHOD AND APPARATUS FOR DETERMINING THE PERFORMANCE OF A COMPACTION MACHINE BASED ON ENERGY TRANSFER

TECHNICAL FIELD

This invention relates generally to a method and apparatus for determining an amount of compactive energy being delivered to a material to be compacted and, more particularly, to a method and apparatus for monitoring the compaction of a material to be compacted as a function of an amount of compactive energy being delivered to the material.

BACKGROUND ART

It is often desired to compact a material for the purpose of reducing the material to a desired density. Examples of applications where compaction is desired include construction sites to prevent further natural settling of the ground, landfill sites where it is desired to compact the landfill waste into as small a volume as possible, and blacktop roads and parking lots, where it is desired to prevent further settling of the blacktop, and hence prevent future cracking of the road or parking lot.

The amount of compaction of these materials must be monitored by some means to determine when the material is compressed to a desired density. In the past, various methods for determining an amount of compaction have been employed. For example, direct measurements of material density may be performed at either random or predetermined locations. The measurements may be made by removing core samples of the material for density measurements, or by sand or water displacement devices. Alternatively, the measurements may be made by some means which does not disturb the material, such as by nuclear gauges, electromagnetic measurement devices, and the like.

The above methods for determining the density of the material being compacted only provide indications of density at the sample locations chosen for testing. In addition, the above methods require additional time and work by the persons performing the tests. This additional time and work increases costs and reduces efficiency of the compaction process. Furthermore, the methods discussed above which disturb portions of the compacted area are not desirable in some situations, e.g., when compacting blacktop in a parking lot, as the disturbance of the material adversely affects the finished product.

In U.S. Pat. No. 5,471,391, Gudat et al. discloses a method and apparatus whereby compacting machines monitor their position with respect to the terrain being compacted, and indicate on a display a number of times portions of the terrain have been passed over by the compactor. In this system, a determination is made as to how many passes would be needed to complete compaction. When the desired number of passes is made over an area, compaction is considered to be complete.

The method and apparatus disclosed by Gudat et al. works well to provide an estimated evaluation of the degree of compaction of a site. However, the method does not measure or determine directly the amount of compaction performed. Therefore, some accuracy is sacrificed to provide the advantage of a real time indication of when compaction is considered to be complete.

The above discussion indicates that many methods have been devised to measure or estimate the amount of compaction that has been performed on a material. However, it is desired to devise a method which can directly measure an amount of compaction, in real time, of the entire volume of material being compacted without intrusively disturbing the material.

The present invention is directed to overcoming one or more of the problems as set forth above.

DISCLOSURE OF THE INVENTION

In one aspect of the present invention a method for determining compaction performance of a material by a compactor having a known compaction width is disclosed. The method includes the steps of determining a lift thickness of the material, determining a rolling resistance of the compactor, determining a level of compactive energy delivered to the material as a function of the compaction width, the lift thickness and the rolling resistance, and determining the compaction performance of the material as a function of the compactive energy.

In another aspect of the present invention a method for determining compaction performance of a material by a compactor is disclosed. The method includes the steps of determining a ground speed of the compactor, determining a rolling resistance of the compactor, determining a propelling power of the compactor as a function of the ground speed and the rolling resistance, and determining the compaction performance of the material as a function of the propelling power of the compactor.

In yet another aspect of the present invention an apparatus for determining compaction performance of a material by a compactor having a known compaction width is disclosed. The apparatus includes means for determining a lift thickness of the material, means for determining a rolling resistance of the compactor, means for determining a level of compactive energy delivered to the material as a function of the compaction width, the lift thickness and the rolling resistance, and means for determining the compaction performance of the material as a function of the compactive energy.

In still another aspect of the present invention an apparatus for determining compaction performance of a material by a compactor is disclosed. The apparatus includes means for determining a ground speed of the compactor, means for determining a rolling resistance of the compactor, means for determining a propelling power of the compactor as a function of the ground speed and the rolling resistance, and means for determining the compaction performance of the material as a function of the propelling power of the compactor.

In yet another aspect of the present invention an apparatus for determining compaction performance of a material by a compactor having a known compaction width is disclosed. The apparatus includes a site coordinate determining system for determining a lift thickness of the material, a first sensor and a second sensor located at the input and the output, respectively, of a torque converter located on the compactor, the first and second sensors being adapted for determining a rolling resistance of the compactor, and a processor located on the compactor for determining a level of compactive energy delivered by the compactor to the material as a function of the compaction width, the lift thickness, and the rolling resistance, the processor being further adapted to determine the compaction performance of the material as a function of the compactive energy.

In still another aspect of the present invention an apparatus for determining compaction performance of a material by a compactor is disclosed. Th apparatus includes a ground speed sensor located on the compactor, a first sensor and a second sensor located at the input and the output, respectively, of a torque converter located on the compactor, the first and second sensors being adapted for determining a rolling resistance of the compactor, and a processor located on the compactor for determining a propelling power of the compactor as a function of the ground speed and the rolling resistance, the processor being further adapted to determine the compaction performance of the material as a function of the propelling power of the compactor.

BEST MODE FOR CARRYING OUT THE INVENTION

With reference to the Figures, a method and apparatus 100 for determining compaction performance of a material by a compactor is shown.

Figure 1:
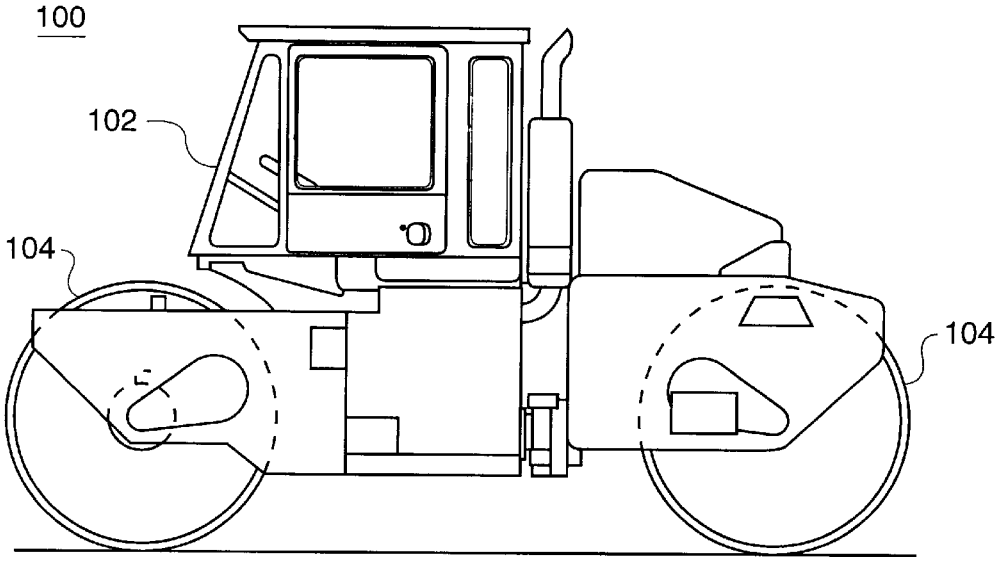
FIG. 1 is a diagrammatic illustration of a compactor suited for use with the present invention.

Referring particularly to FIG. 1, a diagrammatic illustration of a compactor 102 suitable for use with the present invention is shown. Compactors are configured in a variety of ways to perform a variety of compaction operations. For example, landfill compactors are configured to be suitable for compacting landfill waste. Compactors may be designed to compact asphalt for streets and parking lots. Other compactors are suited for compacting soil to prepare a site for additional construction.

In virtually all of these compacting applications, at least one compacting wheel 104 is used to perform the compaction. In FIG. 1, for example, the compactor 102 depicted is shown with two compacting wheels 104. Other compactors may have rows of pneumatic compacting wheels or, in the example of the landfill compactor, may have compacting wheels with teeth to provide additional compaction of the landfill waste. Still other compacting wheels may not be permanently attached to the mobile machine, but may be towed behind the machine.

In all the above examples of compacting wheels, the width of the wheel, and therefore the compaction width W is known. The compaction width W may not be the width of each compaction wheel. For example, a compactor 102 may have a first compaction wheel 104 having a width which differs from the width of a second compaction wheel 104. The compaction width W is the effective width of compaction by the compactor 102.

Figure 2:
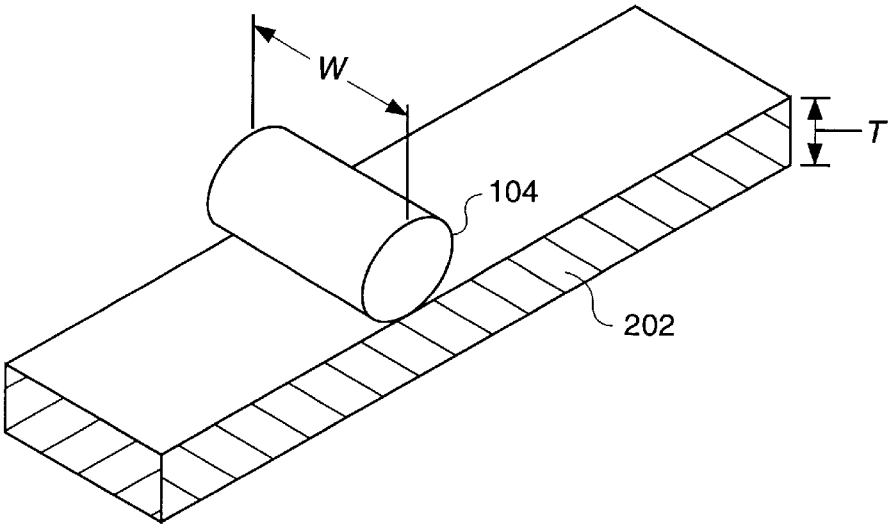
FIG. 2 is a diagrammatic illustration of a compacting wheel on a portion of a material to be compacted.

Referring briefly to FIG. 2, a diagrammatic illustration of a compacting wheel 104 having a known compaction width W is shown on a cross-section of a volume of material 202 to be compacted. The material has a lift thickness T, which decreases as the material 202 is compacted.

Figure 3:
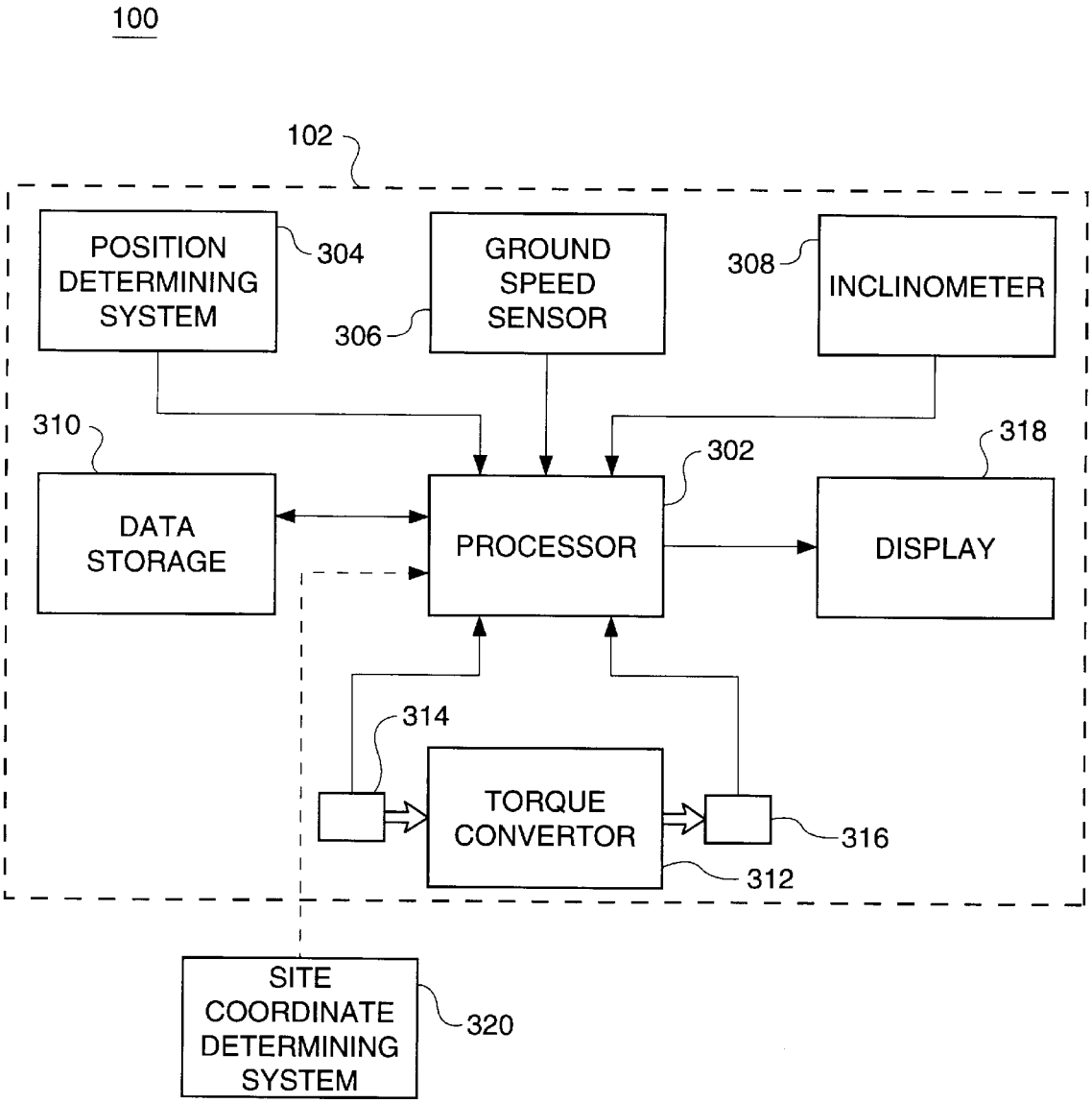
FIG. 3 is a block diagram illustrating a preferred apparatus of the present invention.

Referring now to FIG. 3, a block diagram illustrating a preferred apparatus 100 of the present invention is shown. The elements depicted in FIG. 3 are all-inclusive of two embodiments of the invention, which are discussed in more detail below. Therefore, not all of the elements shown are required for operation of either sole embodiment. If only one of the two embodiments are used in practice, some of the elements in FIG. 3 may not be needed.

A site coordinate determining system 320 is adapted to determine the elevation of the site. The elevation of the site enables determination of the lift thickness T of the material 202. Examples of a site coordinate determining system include, but are not limited to, laser plane systems, GPS systems, manual survey techniques, and the like. The site coordinate determining system 320 of FIG. 3 is depicted as being external from the compactor 102, i.e., located on the site itself. However, the site coordinate determining system 320 may be located on the compactor 102 as well.

A position determining system 304, located on the compactor 102, is adapted to determine the location of the compactor 102. The position determining system 304 may be GPS, laser, dead reckoning, or some other type of system. In an alternative embodiment, the position determining system 304 may be configured to function as the site coordinate determining system 320 as well. For example, the position determining system 304 may employ GPS technology, and may be suited to determine elevation of the material 202, and therefore, the lift thickness T, as the compactor 102 traverses the site.

A ground speed sensor 306, located on the compactor 102, is adapted to sense the ground speed of the compactor 102 as it traverses the site. Ground speed sensors are well known in the art and will not be discussed further. Alternatively, ground speed may be determined from the position determining system 304 by analyzing a series of position determinations to determine velocity from the subsequent positions of the compactor 102.

In the preferred embodiment, an inclinometer 308, located on the compactor 102, is used to determine the slope of a surface on which the compactor 102 is traversing. Alternatively, other types of slope measuring devices, e.g., GPS antennas, laser plane detectors, and the like, could be used as well.

The power to propel the compactor 102 is preferably delivered by means of a torque converter 312, located on the compactor 102. Torque converters are well known components in a drive train of a mobile machine and therefore requires no further discussion. In the preferred embodiment of the present invention, sensors 314,316 are located at the input and output of the torque converter 312. These sensors 314,316 are suited for sensing at least one of pressure, speed, and torque at the torque converter 312. The input sensor 314 senses at least one of pressure, speed, and torque at the input of the torque converter 312, and the output sensor 316 senses a corresponding at least one of pressure, speed, and torque at the output of the torque converter 312. The signals produced by these sensors 314,316 are used to determine a corresponding at least one of a differential pressure, differential speed, and differential torque at the torque converter 312, for reasons discussed below.

A processor 302, located on the compactor 102, is adapted to receive signals from the various sensors and systems shown in FIG. 3 and discussed above. The processor is then able to determine the compaction performance of the material 202 by means of which are discussed in more detail below. The processor 302 may be of any type known in the art, such as a microprocessor commonly used for calculations and control purposes.

A data storage 310 is located, preferably, on the compactor 102, and is used to receive data from the processor 302 and store it for later use. In the preferred embodiment, the data storage 310 is a nonvolatile memory.

An optional display 318, located on the compactor 102 or, alternatively, located at a remote site, or both, receives data from the processor 302 and displays it to an operator or other person. Preferably, the data displayed is relevant to the compaction performance of the material 202 as compaction takes place. In addition, the display 318 may indicate the location of the compactor 102 in real time geographic coordinates. The information displayed may be graphical, text, tabular, numeric, or any type of format desired to effectively display the desired data.

Figure 4:
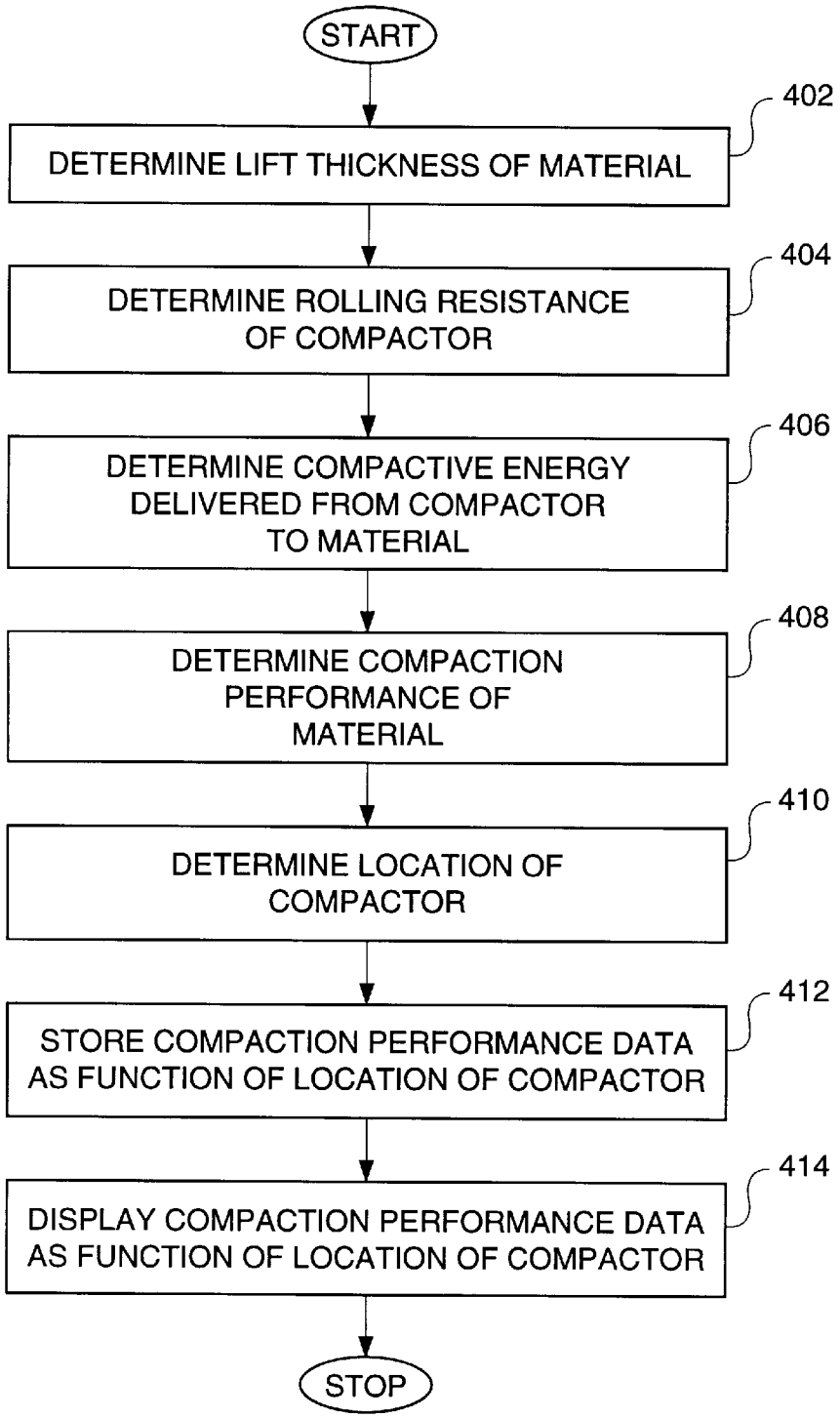
FIG. 4 is a flow diagram illustrating a first embodiment of a preferred method of the present invention.

Referring now to FIG. 4, a flow diagram of a first embodiment of a preferred method of the present invention is shown. Discussion of FIG. 4 will include reference to any of FIGS. 1–3.

In a first control block 402, the lift thickness T of the material 202 is determined, preferably by the site coordinate determining system 320.

In a second control block 404, the rolling resistance of the compactor 102 is determined. Rolling resistance is a characteristic of mobile machines that is well known in the art. For example, in U.S. Pat. No. 5,787,378, Schricker discloses a method for determining the rolling resistance of a mobile machine to detect an abnormal condition such as tire wear of the machine.

In the preferred embodiment of the present invention, rolling resistance is determined by determining at least one of a differential pressure, a differential speed, and a differential torque of the torque converter 312, as measured by the sensors 314,316 located at the input and output, respectively, of the torque converter 312. In addition, slope resistance of the compactor 102 may be determined and compensated for in the rolling resistance determination. The slope of the compactor 102, preferably, is determined by means of the inclinometer 308, as discussed above.

In a third control block 406, the compactive energy delivered from the compactor 102 to the material 202 is determined. In the preferred embodiment, the compactive energy is determined as a function of the known compaction width W, the lift thickness T of the material 202, and the rolling resistance of the compactor 102. Preferably, the compactive energy is determined by the equation:

$$CE = \frac{R}{T * W} \qquad \text{(Equation 1)}$$

where CE is the compactive energy, R is the rolling resistance, T is the lift thickness, and W is the compaction width.

In a fourth control block 408, the compaction performance of the material 202 is determined as a function of the compactive energy. In one embodiment, the compactive energy delivered by the compactor 102 to the material 202 is accumulated during passes over the material 202. When the accumulated total compactive energy delivered reaches a desired predetermined value, compaction is considered to be complete. For example, it may be determined by testing and prior experience that the total compactive energy needed to compact a material 202 is a certain desired amount. The delivery of the compactive energy from the compactor 102 to the material 202 is monitored until the desired amount is attained.

In another embodiment, the compactive energy being delivered by the compactor 102 to the material 202 is monitored on each pass. As the material 202 is compacted on each pass, the amount of compactive energy delivered decreases until an asymptotic value is reached, i.e., the amount of decrease in compactive energy delivered is below a threshold. Compaction may be considered to be complete when the amount of compactive energy delivered on a pass is below a predetermined value. Alternatively, compaction may be considered to be complete when the difference in compactive energy delivered from a pass to a subsequent pass is determined to be below a predetermined value.

In a fifth control block 410, the location of the compactor 102 relative to the area being compacted is determined. Preferably, the location of the compactor 102 is determined by means of a position determining system 304, such as GPS, laser positioning, dead reckoning, and the like.

In a sixth control block 412, the compaction performance data determined by the means discussed above is stored in the data storage 310, e.g., a memory storage unit. Preferably, the data is location dependent, that is, compaction performance data is stored as a function of the location of the material 202 in site coordinates. In addition, the location of the compactor 102 may be stored in memory in real time to track the coverage on the compactor 102 at the compaction site, and to track the number of passes made by the compactor 102. Optionally, the compaction performance data may be delivered to a remote site by means well known in the art, such as wireless radio (not shown).

In a seventh control block 414, the compaction performance data is displayed on a display 318. In addition, the location of the compactor 102 relative to the area being compacted may also be displayed. Although FIG. 3 indicates the display 318 being located on the compactor 102, the display 318, or one or more additional displays 318, may be located at one or more remote sites.

Figure 5:
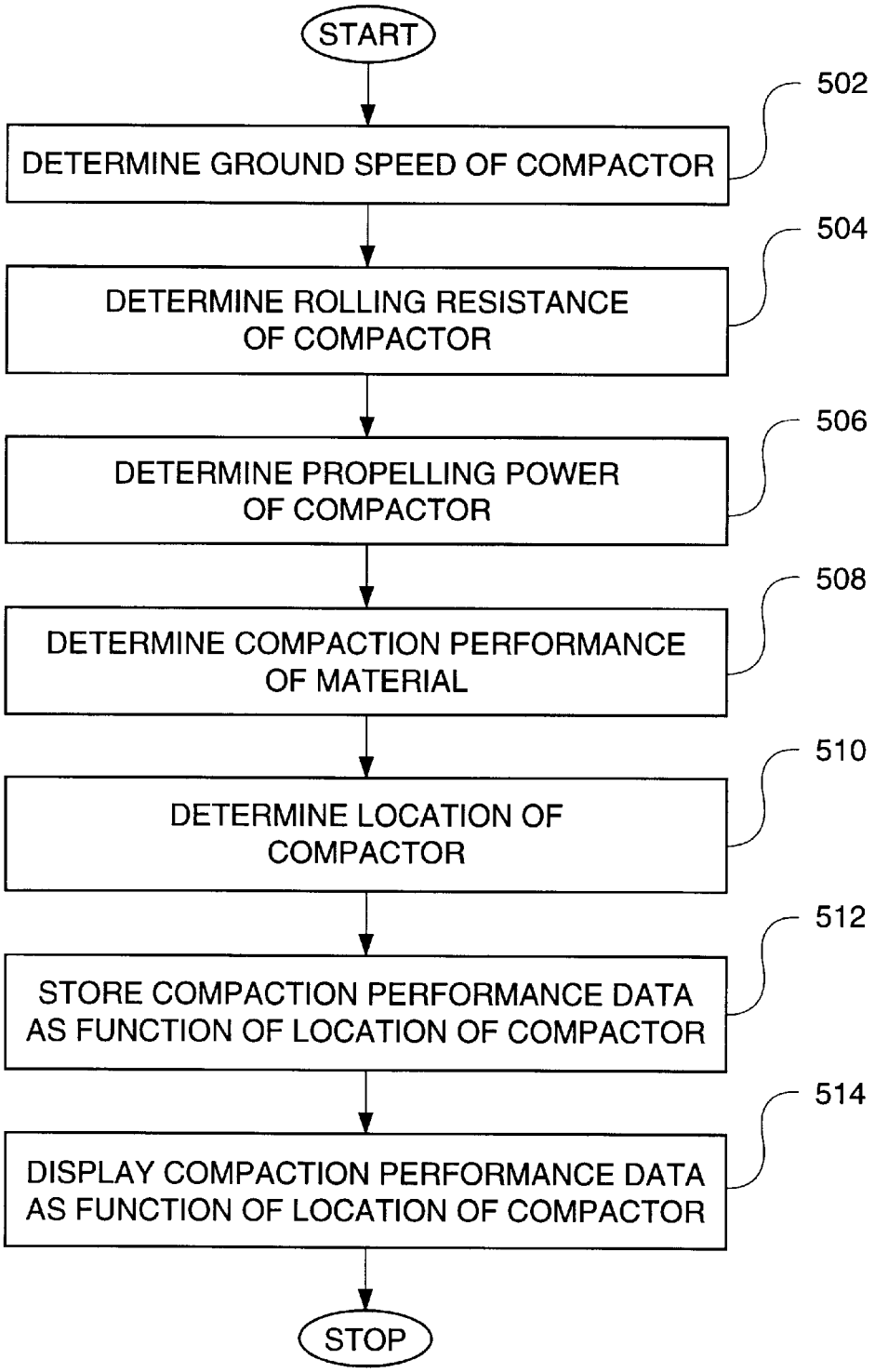
FIG. 5 is a flow diagram illustrating a second embodiment of a preferred method of the present invention.

Referring now to FIG. 5, a flow diagram of a second embodiment of a preferred method of the present invention is shown.

In a first control block 502, the ground speed of the compactor 102 is determined, preferably by the ground speed sensor 306.

In a second control block 504, the rolling resistance of the compactor 102 is determined as discussed above.

In a third control block 506, the propelling power of the compactor 102 is determined. In the preferred embodiment, the propelling power is determined as a function of the ground speed and the rolling resistance of the compactor 102. The propelling power corresponds to the compactive energy delivered by the compactor 102 to the material 202. However, in this embodiment, determination of the propelling power does not require direct knowledge of characteristics of the material 202, such as the lift thickness T.

Preferably, the propelling power is determined as the product of the ground speed and the rolling resistance. However, alternative methods for determining the propelling power of the compactor 102 may be used, such as the product of torque and rotational velocity, the product of hydraulic flow rate and hydraulic pressure, and the rate of fuel consumption.

In the preferred embodiment, the propelling power is compensated by taking into account such factors as the rate of energy loss internal to the compactor 102, e.g., losses in bearings, gears, torque converters, hydraulic fluid, and the like, the rate of gain of potential energy of the compactor 102, and the rate of wind energy being applied to the compactor 102. The rate of gain of potential energy of the compactor 102 is preferably determined by taking the product of the weight of the compactor 102, the slope of the surface which the compactor 102 is on, and the ground speed of the compactor 102. The rate of wind energy applied to the compactor 102 is preferably determined as a function of the speed and the direction of the wind relative to the direction of the compactor 102.

Preferably, the net propelling power, i.e., the propelling power after the above compensation factors are taken into account, is determined by the equation:

$$PP_{net}=PP-PP_{int}-PP_{pot}-PP_{wind} \quad \text{(Equation 2)}$$

where $PP_{net}$ is the net propelling power, PP is the propelling power without compensation, $PP_{int}$ is the rate of internal energy loss, $PP_{pot}$ is the rate of gain of potential energy, and $PP_{wind}$ is the rate of wind energy.

In a fourth control block 508, the compaction performance of the material 202 is determined. The propelling power is found to decrease as the compaction of the material 202 increases, which corresponds to the value of compactive energy being delivered from the compactor 102 to the material 202 decreasing as the compaction of the material 202 increases. Therefore, compaction is considered to be complete when the propelling power decreases below a predetermined threshold value. The compaction performance of the material 202 is determined therefore as a function of the net propelling power of the compactor 102 decreasing below a predetermined value during a pass. Alternatively, the compaction performance of the material 202 is determined as a function of the difference in the net propelling power of the compactor 102 decreasing below a predetermined value between a pass and a subsequent pass.

In a fifth control block 510, the location of the compactor 102 is determined as discussed above. In a sixth control block 512, the compaction performance data is stored as a function of the location of the compactor 102, as discussed above. In a seventh control block 514, the compaction performance data is displayed as a function of the location of the compactor 102, as discussed above.

INDUSTRIAL APPLICABILITY

As an example of an application of the present invention, it is important in terms of productivity, efficiency, and cost savings to be able to effectively monitor compaction performance in real time. The monitoring of compactive energy being transferred from the compactor 102 to the material 202 provides a method to achieve a direct indication of compaction, as opposed to indirect methods, i.e., core sampling, use of nuclear gauges and other indirect measuring devices, and counting the number of passes. Previous methods are indicators of compaction, but do not provide direct measure of compaction performance in real time.

Other aspects, objects, and features of the present invention can be obtained from a study of the drawings, the disclosure, and the appended claims.

What is claimed is:

1. A method for determining compaction performance of a material by a compactor having a known compaction width, including the steps of:

determining a lift thickness of the material;

determining a rolling resistance of the compactor;

determining a level of compactive energy delivered by the compactor to the material as a function of the compaction width, the lift thickness of the material, and the rolling resistance of the compactor; and determining the compaction performance of the material as a function of the compactive energy.

2. A method, as set forth in claim 1, further including the step of storing data relative to the compaction performance of the material in a database.

3. A method, as set forth in claim 2, further including the step of determining the location of the compactor relative to the area being compacted.

4. A method, as set forth in claim 3, wherein the stored data is a function of the location of the compactor.

5. A method, as set forth in claim 4, further including the step of displaying the data relative to the compaction performance of the material and displaying the location of the compactor relative to the area being compacted.

6. A method, as set forth in claim 2, further including the step of displaying the data relative to the compaction performance of the material.

7. A method, as set forth in claim 1, wherein the lift thickness of the material is determined by detecting an elevation of the material.

8. A method, as set forth in claim 1, wherein determining a rolling resistance of the compactor includes determining at least one of a differential pressure, a differential speed, and a differential torque between an input and an output of a torque converter located on the compactor.

9. A method, as set forth in claim 8, wherein determining a rolling resistance of the compactor further includes compensating for slope resistance of the compactor on a sloped surface.

10. A method, as set forth in claim 1, wherein determining a level of compactive energy is determined by the equation:

$$CE = \frac{R}{T * W}$$

where CE is the compactive energy, R is the rolling resistance, T is the lift thickness, and W is the compaction width.

11. A method, as set forth in claim 1, wherein determining the compaction performance of the material is determined as a function of an accumulation of compactive energy delivered by the compactor to the material over several passes.

12. A method, as set forth in claim 1, wherein determining the compaction performance of the material is determined as a function of the compactive energy delivered by the compactor to the material decreasing below a predetermined value during a pass.

13. A method, as set forth in claim 1, wherein determining the compaction performance of the material is determined as a function of the difference in compactive energy delivered by the compactor to the material decreasing below a predetermined value between a pass and a subsequent pass.

14. A method for determining compaction performance of a material by a compactor, including the steps of:

determining a ground speed of the compactor;

determining a rolling resistance of the compactor;

determining a propelling power of the compactor as a function of the ground speed and the rolling resistance, the propelling power corresponding to a level of compactive energy delivered by the compactor to the material; and determining the compaction performance of the material as a function of the propelling power of the compactor being below a predetermined value.

15. A method, as set forth in claim 14, further including the step of storing data relative to the compaction performance of the material in a database.

16. A method, as set forth in claim 15, further including the step of determining the location of the compactor relative to the area being compacted.

17. A method, as set forth in claim 16, wherein the stored data is a function of the location of the compactor.

18. A method, as set forth in claim 17, further including the step of displaying the data relative to the compaction performance of the material and displaying the location of the compactor relative to the area being compacted.

19. A method, as set forth in claim 15, further including the step of displaying the data relative to the compaction performance of the material.

20. A method, as set forth in claim 14, wherein determining a rolling resistance of the compactor includes determining at least one of a differential pressure, a differential speed, and a differential torque between an input and an output of a torque converter located on the compactor.

21. A method, as set forth in claim 20, wherein determining a rolling resistance of the compactor further includes compensating for slope resistance of the compactor on a sloped surface.

22. A method, as set forth in claim 14, wherein determining a propelling power of the compactor includes the step of compensating the determined propelling power for at least one of the rate of energy loss internal to the compactor, the rate of gain of potential energy of the compactor, and the rate of wind energy applied to the compactor, the compensated propelling power being a net propelling power of the compactor.

23. A method, as set forth in claim 22, wherein the net propelling power is determined by the equation:

$$PP_{net}=PP-PP_{int}-PP_{pot}-PP_{wind}$$

where $PP_{net}$ is the net propelling power, PP is the propelling power without compensation, $PP_{int}$ is the rate of internal energy loss, $PP_{pot}$ is the rate of gain of potential energy, and $PP_{wind}$ is the rate of wind energy.

24. A method, as set forth in claim 23, wherein the rate of gain of potential energy of the compactor is determined as a function of the weight of the compactor, the slope of the surface which the compactor is on, and the ground speed of the compactor.

25. A method, as set forth in claim 23, wherein the rate of wind energy applied to the compactor is determined as a function of the speed and the direction of the wind relative to the direction of the compactor.

26. A method, as set forth in claim 23, wherein determining the compaction performance of the material is determined as a function of the net propelling power of the compactor decreasing below a predetermined value during a pass.

27. A method, as set forth in claim 23, wherein determining the compaction performance of the material is determined as a function of the difference in the net propelling power of the compactor decreasing below a predetermined value between a pass and a subsequent pass.

28. An apparatus for determining compaction performance of a material by a compactor having a known compaction width, comprising:

means for determining a lift thickness of the material;

means for determining a rolling resistance of the compactor;

means for determining a level of compactive energy delivered by the compactor to the material as a function of the compaction width, the lift thickness of the material, and the rolling resistance of the compactor; and means for determining the compaction performance of the material as a function of the compactive energy.

29. An apparatus, as set forth in claim 28, further including means for determining the location of the compactor relative to the area being compacted.

30. An apparatus, as set forth in claim 29, wherein the means for determining the location of the compactor includes a position determining system.

31. An apparatus, as set forth in claim 29, further including means for storing data relative to the compaction performance of the material in a database, wherein the stored data is a function of the location of the compactor.

32. An apparatus, as set forth in claim 31, further including means for displaying the data relative to the compaction performance of the material and displaying the location of the compactor relative to the area being compacted.

33. An apparatus, as set forth in claim 32, wherein the means for displaying the data includes a display monitor.

34. An apparatus, as set forth in claim 28, wherein the means for determining a lift thickness of the material includes means for determining an elevation of the material in site coordinates.

35. An apparatus, as set forth in claim 34, wherein the means for determining an elevation of the material includes a site coordinate determining system.

36. An apparatus, as set forth in claim 28, wherein the means for determining a rolling resistance includes means for determining at least one of a differential pressure, a differential speed, and a differential torque between an input and an output of a torque converter located on the compactor.

37. An apparatus, as set forth in claim 36, wherein the means for determining a rolling resistance of the compactor further includes means for compensating for slope resistance of the compactor on a sloped surface.

38. An apparatus, as set forth in claim 37, wherein the means for compensating for slope resistance includes an inclinometer located on the compactor.

39. An apparatus for determining compaction performance of a material by a compactor, comprising:

means for determining a ground speed of the compactor;

means for determining a rolling resistance of the compactor;

means for determining a propelling power of the compactor as a function of the ground speed and the rolling resistance, the propelling power corresponding to a level of compactive energy delivered by the compactor to the material; and means for determining the compaction performance of the material as a function of the propelling power of the compactor being below a predetermined value.

40. An apparatus for determining compaction performance of a material by a compactor having a known compaction width, comprising:

a site coordinate determining system for determining a lift thickness of the material;

a first sensor and a second sensor located at the input and the output, respectively, of a torque converter located on the compactor, the first and second sensors being adapted to sense a differential characteristic between the input and the output of the torque converter for determining a rolling resistance of the compactor; and a processor located on the compactor for determining a level of compactive energy delivered by the compactor to the material as a function of the compaction width, the lift thickness of the material, and the rolling resistance of the compactor, the processor being further adapted to determine the compaction performance of the material as a function of the compactive energy.

41. An apparatus, as set forth in claim 40, wherein the differential characteristic between the input and the output of the torque converter includes at least one of a differential pressure, a differential speed, and a differential torque between the input and the output of the torque converter.

42. An apparatus for determining compaction performance of a material by a compactor, comprising:

a ground speed sensor located on the compactor;

a first sensor and a second sensor located at the input and the output, respectively, of a torque converter located on the compactor, the first and second sensors being adapted to sense a differential characteristic between the input and the output of the torque converter for determining a rolling resistance of the compactor; and a processor located on the compactor for determining a propelling power of the compactor as a function of the ground speed and the rolling resistance, the propelling power corresponding to a level of compactive energy delivered by the compactor to the material, the processor being further adapted to determine the compaction performance of the material as a function of the propelling power of the compactor being below a predetermined value.

* * * * *